US005838340A

United States Patent [19]

Shimoda

[11] Patent Number: 5,838,340

[45] Date of Patent: Nov. 17, 1998

[54] INK-JET PRINTING METHOD AND APPARATUS THEREFOR

[75] Inventor: Junji Shimoda, Chigasaki, Japan

[73] Assignee: Canon Kabushiki Kaisha, Tokyo, Japan

[21] Appl. No.: 508,305

[22] Filed: Jul. 27, 1995

[30] Foreign Application Priority Data

Jul. 29, 1994 [JP] Japan ..... 6-179135

[51] Int. Cl.[6] ..... B41J 2/05

[52] U.S. Cl. ..... 347/14; 347/60

[58] Field of Search ..... 347/14, 17, 60, 347/57

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. | 347/60 X |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,910,528 | 3/1990 | Firl et al. | 347/17 |
| 5,281,980 | 1/1994 | Kishida et al. | 347/13 |
| 5,559,535 | 9/1996 | Otsuka | 347/14 |
| 5,576,745 | 11/1996 | Matsubara | 347/14 |

FOREIGN PATENT DOCUMENTS

| | | | |
|---|---|---|---|
| 0475638 | 3/1992 | European Pat. Off. | B41J 2/05 |
| 0496525 | 7/1992 | European Pat. Off. | B41J 2/195 |
| 0511602 | 11/1992 | European Pat. Off. | B41J 2/05 |
| 0526223 | 2/1993 | European Pat. Off. | B41J 2/07 |
| 0600648 | 6/1994 | European Pat. Off. | B41J 2/05 |
| 54-056847 | 5/1979 | Japan | B41M 5/26 |
| 59-123670 | 7/1984 | Japan | B41J 3/04 |
| 59-138461 | 8/1984 | Japan | B41M 3/04 |
| 60-071260 | 4/1985 | Japan | B41J 3/04 |
| 3277553 | 12/1991 | Japan | B41J 2/05 |
| 4250057 | 9/1992 | Japan | B41J 2/12 |
| 5064890 | 3/1993 | Japan | B41J 2/125 |
| 2218380 | 11/1989 | United Kingdom | B41J 3/04 |

*Primary Examiner*—Joseph W. Hartary

*Attorney, Agent, or Firm*—Fitzpatrick, Cella, Harper & Scinto

[57] ABSTRACT

An ink-jet printing apparatus can obtain good image quality and improve reliability by avoiding possibility of failure of the head. A target temperature, at which ejection of ink through an ink-jet printing head becomes the most stable is set. Also, a difference between the target temperature and an actual temperature of the ink-jet printing head is derived. When the difference is positive, the drive signal includes a pre-heating pulse and a main heating pulse having an interval therebetween. The pulse width or the interval is properly set. When the drive signal is negative, only the main heating pulse is included. When the absolute value of the difference is large, the pulse widths are set smaller. At this time, a drive frequency is lowered or a resting period at opposite end positions in the scanning directions is prolonged.

14 Claims, 9 Drawing Sheets

P1 : PRE-HEATING PULSE (=T1)

P2 : INTERVAL (=T2−T1)

P3 : MAIN HEATING PULSE (=T3−T2)

Vop : DRIVE VOLTAGE

INK-JET PRINTING METHOD AND APPARATUS THEREFOR

FIELD OF THE INVENTION

Background of the Invention

The present invention relates to an ink-jet printing method and an ink-jet printing apparatus for forming a character image or a graphic image by ejecting ink or liquid droplets through a plurality of ejection orifices toward a recording medium depending upon image information, utilizing thermal energy.

Description of the Related Art

Conventionally, such ink-jet printing method and apparatus have been designed to form a printed image by ejecting liquid droplets through a plurality of ejection orifices toward a recording medium depending upon image information, with employing an ink-jet printing head having a plurality of heating elements for generating thermal energy. In such ink-jet printing system, a drive signal to be supplied to the heating element is optimized depending upon a temperature of the printing head, by measuring or predicting the temperature at the printing head.

Means for predicting the temperature of the ink-jet printing head has been disclosed in Japanese Patent Application Laid-Open No. 64890/1993. The disclosed means employs a method for arithmetically predicting a head temperature on the basis of an environmental temperature of the head and printing hysteresis, instead of providing a head temperature sensor or so forth. Further, in the above-identified Japanese Patent Application Laid-Open No. 64890/1993, the drive signal includes a pre-heating pulse and a main-heating pulse so that a pulse width of the preheating pulse is varied on the basis of a predicted temperature in order to suppress variation of ejection amount due to temperature variation.

On the other hand, in Japanese Patent Application Laid-Open No. 250057/1992, a technology for suppressing variation of the ejection amount by controlling a drive pulse width depending upon position and number of ejection orifices to be used for recording, has been disclosed.

Also, in Japanese Patent Application Laid-Open No. 277553/1991, a method for adjusting ejection amount per a group of recording elements to be uniform by varying driving condition of the group of recording elements which are driven simultaneously has been disclosed.

It should be noted that the term "printing" or "recording" used throughout this specification does not only include printing or recording on a printing paper sheet or so forth, but also includes printing of an image, pattern or so forth on a cloth or so forth.

In the prior art such as those set forth above, when the temperature of the printing head rises upon continuous printing of a high density image, defect of the printed image, such as increasing of mist, satellite and so forth due to excessively high temperature of the printing head, failure of ejection due to accumulation of bubbles in the printing head, or in worse case, failure of operation of the printing head due to excessive elevation of the temperature in the printing head may be caused.

It is considered that such problem has arisen due to insufficiency of optimization of driving condition in view point of restriction of input energy for the printing heat at high temperature for avoiding further elevation of the temperature of the printing head.

SUMMARY OF THE INVENTION

Therefore, it is an object of the present invention to solve the problems set forth above, and to provide an ink-jet printing method and apparatus therefor, each of which can obtain high printed image quality even in continuous printing of high density image or at high environmental temperature, and can avoid failure in operation of a printing head to provide high reliability.

It should be noted that the wording "environmental temperature" used throughout this specification is an atmospheric temperature around a printing head. When measured by a temperature sensor in a printing apparatus, the environmental temperature is a temperature which can be measured by the temperature sensor. On the other hand, when measured by a temperature sensor within the printing head, the environmental temperature is a temperature which can be measured by the temperature sensor after expiration of a given period (e.g. 20 to 30 minutes) from turning OFF of a power supply for the printing apparatus and at a timing where the head temperature can be regarded to be equal to the atmospheric temperature.

In a first aspect of the present invention, there is provided an ink-jet printing method for performing printing on a recording medium by ejecting ink from an ink-jet printing head having ejection orifices utilizing thermal energy, comprising the steps of:

setting a target temperature, at which ejection of the ink-jet printing head is the stablest, on the basis of an environmental temperature;

deriving a difference between the set target temperature and an actual temperature of the ink-jet printing head; and controlling energy supply for the ink-jet printing head by deriving a proper value of a drive signal which supplies at least the thermal energy so that the temperature of the ink-jet printing head may reach the target temperature corresponding to a magnitude of the difference; and wherein the drive signal includes a pre-heating pulse providing thermal energy which does not cause bubbling of the ink and a main heating pulse having a given interval to the pre-heating pulse and providing thermal energy which causes bubbling of the ink for ejection of ink from the ejection orifices, when the difference derived by subtracting the actual temperature of the ink-jet printing head from the target temperature is positive, and the drive signal includes only a main heating pulse, the width of the main heating pulse being reduced according to increasing of the absolute value of the difference, when the difference subtracting the actual temperature of the ink-jet printing head from the target temperature is negative.

The ink-jet printing head may be provided with a heater for heating, when the difference derived by subtracting the actual temperature of the ink-jet printing head from the target temperature is positive and exceeds a predetermined value, the ink-jet printing head is heated for a given period by the heater for heating.

The pre-heating pulse and the main heating pulse may be predetermined values with a constant width, respectively, and the interval is increased corresponding to increasing of the difference, when the difference derived by subtracting the actual temperature of the ink-jet printing head from the target temperature is positive.

An ink-jet printing method may further comprise the step of:

lowering a drive frequency of the main heating pulse when the difference derived by subtracting the actual temperature of the ink-jet printing head from the target temperature is negative and the absolute value of the difference is greater than a predetermined value.

The method may perform by scanning the ink-jet printing head and placing the ink-jet printing head at resting state for a predetermined resting period at opposite ends in scanning directions, wherein the predetermined resting period is prolonged, when the difference is negative and the absolute value thereof is greater than a predetermined value.

The environmental temperature may be set by measuring a temperature in the apparatus by a temperature sensor arranged within the ink-jet printing apparatus and setting on the basis of the measured temperature.

The environmental temperature may be set on the basis of a temperature detected by a head temperature detecting means upon expiration of a predetermined period after turning off of a power source of the ink-jet printing apparatus.

In a second aspect of the present invention, there is provided an ink-jet printing apparatus for performing printing on a recording medium by employing an ink-jet printing head which ejects ink through ejection orifices utilizing thermal energy, comprising:

target temperature setting means for setting a target temperature, at which ejection through the ink-jet printing head is the stablest, on the basis of an environmental temperature;

head temperature detecting means for detecting a temperature of the ink-jet printing head;

drive signal setting means for setting a drive signal at a proper value for providing the thermal energy so that a temperature of the ink-jet printing head may reach the target temperature depending upon a difference between the set target temperature by the target temperature setting means and a detected temperature detected by the head temperature detecting means; and drive control means for controlling driving of the ink-jet printing head on the basis of the drive signal set by the drive signal setting means;

wherein the drive signal includes a pre-heating pulse providing thermal energy which does not cause bubbling of the ink and a main heating pulse having a given interval to the pre-heating pulse and providing thermal energy which causes bubbling of the ink for ejection of ink from the ejection orifices, when the difference derived by subtracting the actual temperature of the ink-jet printing head from the target temperature is positive, and the drive signal includes only a main heating pulse, the width of the main heating pulse being reduced according to increasing of the absolute value of the difference, when the difference derived by subtracting the actual temperature of the ink-jet printing head from the target temperature is negative.

The ink-jet printing head may be further provided with a heater for heating, and has power supply control means for supplying power for a predetermined period for the heater when the difference derived by subtracting an actual temperature of the ink-jet printing head from the target temperature exceeds a predetermined value.

The pre-heating pulse and the main heating pulse may be predetermined values with a constant width, respectively, and the interval is increased corresponding to increasing of the difference, when the difference derived by subtracting the actual temperature of the ink-jet printing head from the target temperature is positive.

A drive frequency of the main heating pulse may be lowered when the difference derived by subtracting an actual temperature of the ink-jet printing head from the target temperature is negative and the absolute value of the difference is greater than a predetermined value.

An ink-jet printing apparatus may further comprise: shifting control means for reciprocally scanning the ink-jet printing head in scanning directions and for placing the ink-jet printing head at resting state for a predetermined resting period at opposite ends in the scanning directions; and wherein the shifting control means prolongs the predetermined resting period when the difference is negative and the absolute value thereof is greater than a predetermined value.

An ink-jet printing apparatus may further comprise:

a temperature sensor arranged within the apparatus; and wherein the temperature sensor detects the environmental temperature.

The environmental temperature may be derived from a temperature detected by the heat temperature detecting means upon expiration of predetermined period after turning off of a power source of the ink-jet printing apparatus.

With the present invention, a target temperature, at which ejection from the ink-jet printing head becomes most stable, is set on the basis of the environmental temperature. An actual head temperature is controlled to reach the target temperature.

In one aspect of the invention, an appropriate value of the drive signal for providing thermal energy to the head is derived on the basis of a difference between the target temperature and the actual head temperature. Then, the drive signal is controlled on the basis of the appropriate value.

In another aspect of the invention, when the difference is greater than a given positive value (the actual temperature is lower than the target temperature), a heater provided on the head is used to quickly elevate the head temperature.

When the difference is a positive value smaller than the given positive value, pulse widths or intervals of the pre-heating pulse and the main heating pulse of the drive signal are determined appropriately so that the temperature of the head is moderately elevated only by own temperature rising.

On the other hand, when the difference is negative, the drive signal only contains the main pulse. Then, since the pulse width can be reduced corresponding to increasing of the absolute value of the difference, excessive elevation of the temperature of the head can be successfully prevented.

Moreover, when the difference is a negative value which absolute value is greater than a predetermined value, the drive frequency of the main heating pulse is lowered and, in another aspect of the invention, the resting period at opposite ends in scanning directions is prolonged, so that the temperature rise of the head is suppressed due to lowering average energy to be given.

As can be clear from the above, with the present invention, since ejection amount can be uniform within each temperature range, high printing image quality without any fluctuation can be realized.

Also, the present invention can provide highly reliable ink-jet printing method and apparatus with avoiding possibility of causing failure of ejection due to accumulation of bubble in the head or damaging of the head due to excessive elevation of the head temperature, even when the temperature of the printing head is high upon continuous printing of a high density image or under high environmental temperature.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

One embodiment of an ink-jet printing apparatus to which the present invention is applied will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

Figure 1:
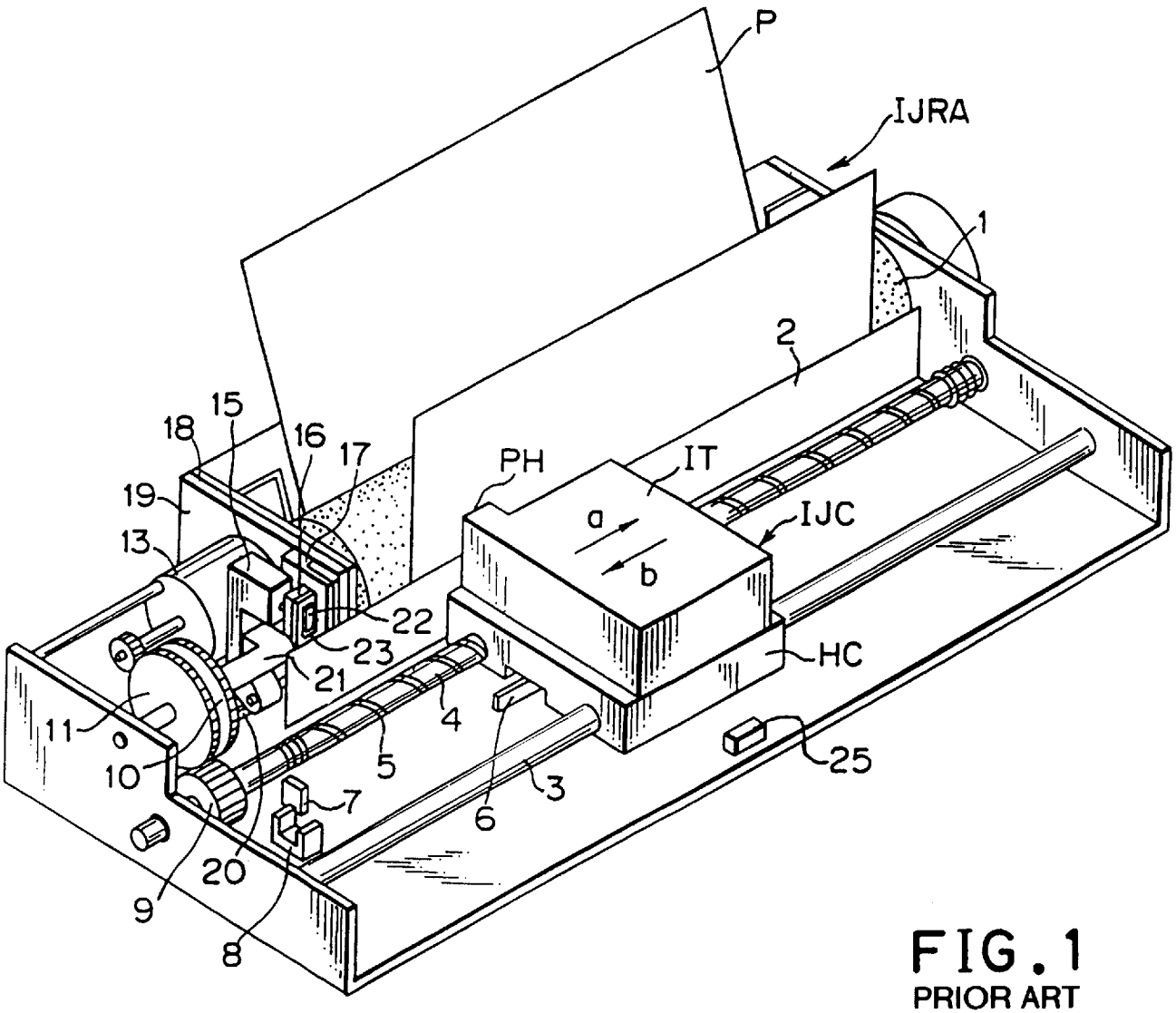
FIG. 1 PRIOR ART
FIG. 1 is a perspective view showing one embodiment of an ink-jet printing apparatus, for which the present invention is applied.

FIG. 1 shows an external appearance of one embodiment of an ink-jet recording apparatus IJRA to which the present invention is applied. In FIG. 1, a carriage HC which engages with a spiral groove 5 of a lead screw 4 driven to rotate by a driving motor 13 in forward and reverse direction via a driving torque transmission gears 11 and 9, has a pin (not shown), is driven to reciprocate along a guide shaft 3 in scanning directions shown by arrows a and b. On the carriage HC, an ink-jet cartridge IJC including a printing head PH is mounted. The reference numeral 2 denotes a paper holder plate, which holds a paper sheet with respect to a platen 1 over the carriage shifting direction. 7 and 8 denote a photo coupler serving as a home position detecting means which detects presence of the lever 6 of the carriage HC within a zone where the photo coupler is provided and acts for switching of driving direction of the main scanning motor 13. 16 denotes a supporting member of a cap member 22 for capping overall surface of the recording head PH, 15 denotes a sucking member for suction in the cap for suction recovery of the recording head via an opening 23 within the cap. 17 denotes a cleaning blade for wiping, 19 denotes a shifting member for permitting movement of the blade in back and forth directions. The cleaning blade 17 and the shifting member 19 are supported by a main body supporting plate 18. It should be noted that the shape of the blade is not specific to the shown one, and, as a matter of course, known cleaning blade is applicable for this embodiment.

On the other hand, the reference numeral 21 denotes a lever for initiating sucking for suction recovery, which lever 21 shifts according to movement of a cam engaging with the carriage HC. A driving force from the driving motor 13 is controlled via a known transmission means, such as switch of clutch 10 or so forth.

In the shown embodiment, these capping, cleaning and suction recovery devices are designed to perform designed processes at the corresponding positions by the action of the lead screw 4 when the carriage HC has reached in a zone on the home position side. However, by designing the apparatus to perform capping, cleaning and suction recovery at known timings, any arrangements may be applicable.

The ink-jet cartridge IJC in the shown embodiment is provided with a large ink storage ratio and has the printing head PH slightly projecting the tip end thereof from the front surface of an ink tank IT. The ink-jet cartridge IJC is a type to be fixedly supported on the carriage HC installed in the ink-jet recording apparatus main body IJRA by means of a positioning means and electric contacts, and is detachable from the carriage HC. It should be noted that the reference numeral 25 denotes a temperature sensor which is optionally provided within the apparatus for detecting a temperature within the apparatus, as required.

Figure 2:
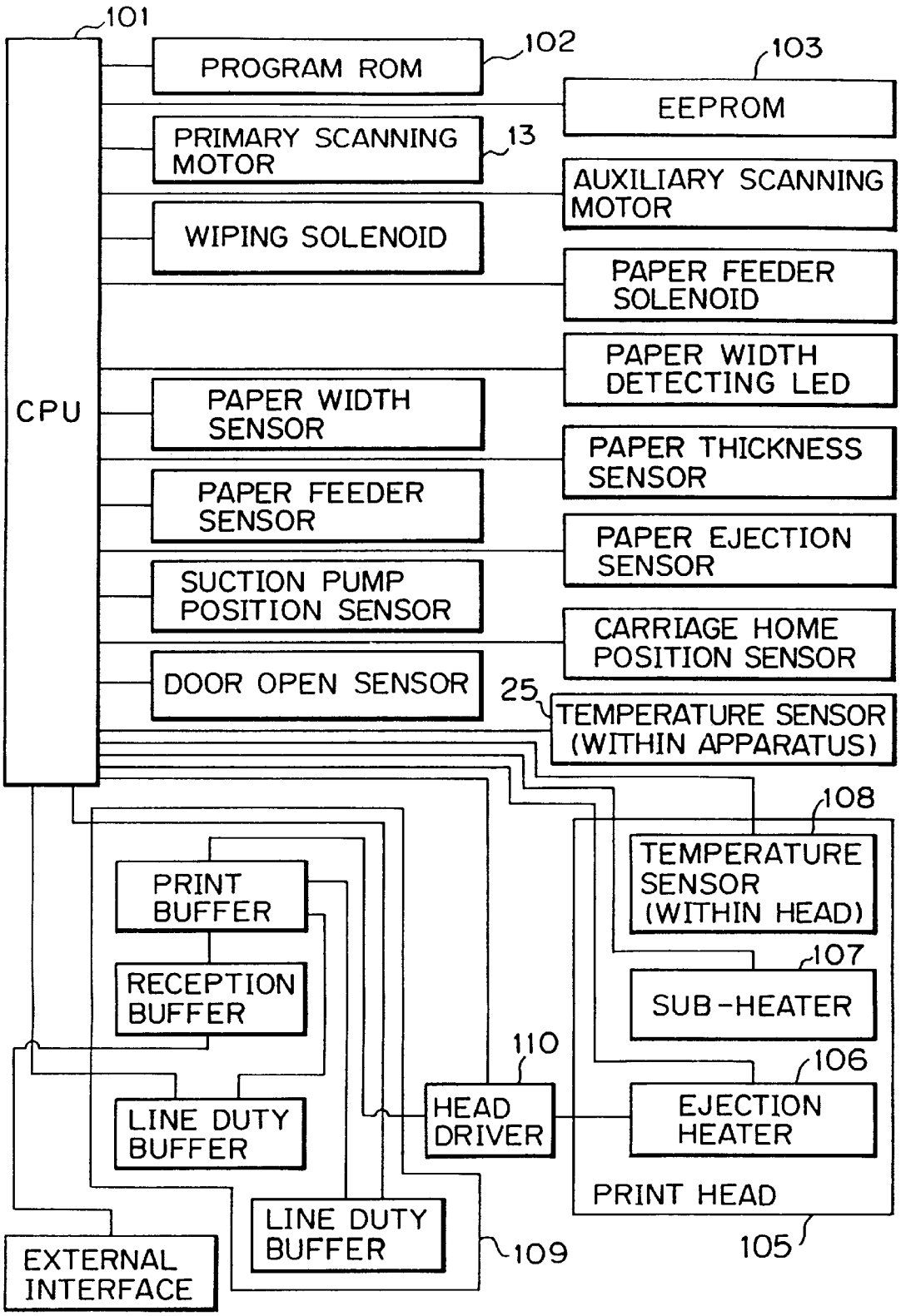
FIG.2 PRIOR ART
FIG. 2 is a block diagram for explaining a control circuit in one embodiment of the ink-jet printing apparatus according to the invention.

FIG. 2 is a block diagram for explanation of an electric control circuit of the ink-jet recording apparatus according to the present invention. In FIG. 2, 101 denotes a CPU, 102 denotes a program ROM storing a control program to be executed by the CPU 101, 103 denotes an EEPROM for storing various data. In addition, the main scanning motor 13, a solenoid for wiping operation, a sensor for detecting a paper sheet width, an auxiliary scanning motor for feeding a recording paper sheet and so forth are connected to the CPU in a manner shown in FIG. 2.

Reference numeral 105 denotes the printing head PH. An ejection heater 106 as an energy generating element for forming recording liquid droplets, a sub-heater 107 serving as a heating heater for heating the printing head 105 and thus heating ink therein, and a temperature sensor 108 in the head for detecting an ink temperature within the printing head 105 are provided. These components are constructed integrally as the printing head (detail will be discussed later). Reference numeral 109 denotes a gate array for performing supply control of a recording data for the printing head, 110 denotes a head driver for driving the head.

Figure 3:
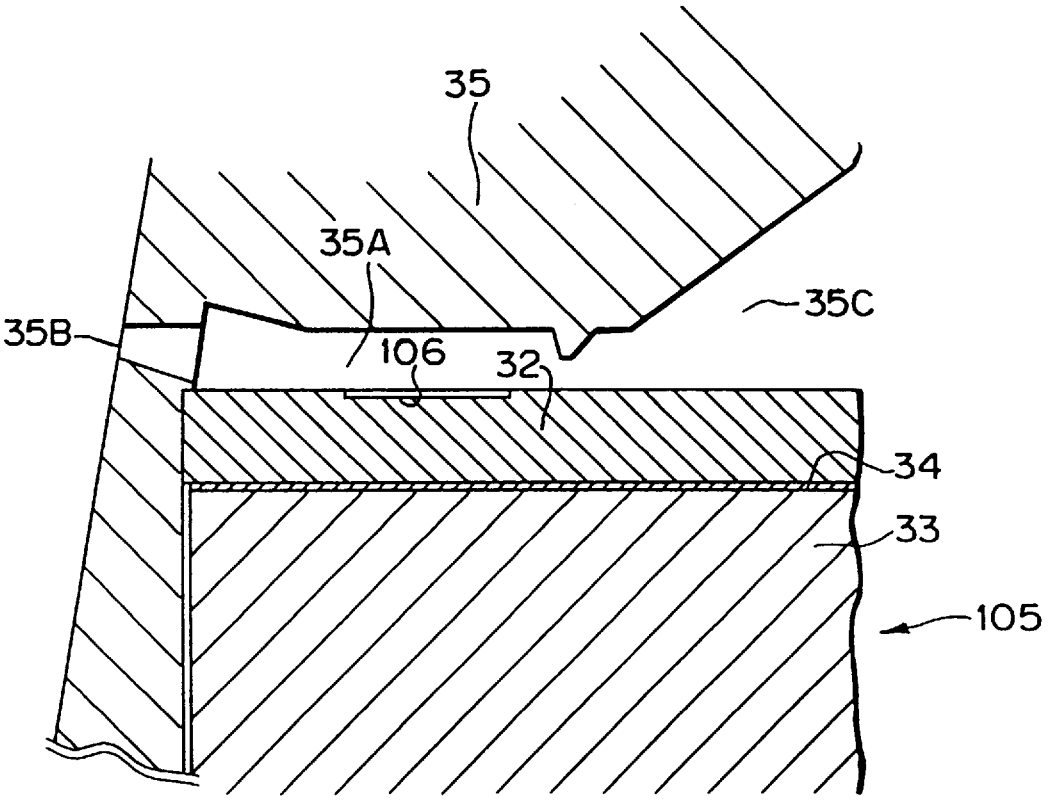
FIG. 3 PRIOR ART
FIG. 3 is a partial enlarged section showing one example of a construction of a printing head.
Figure 4:
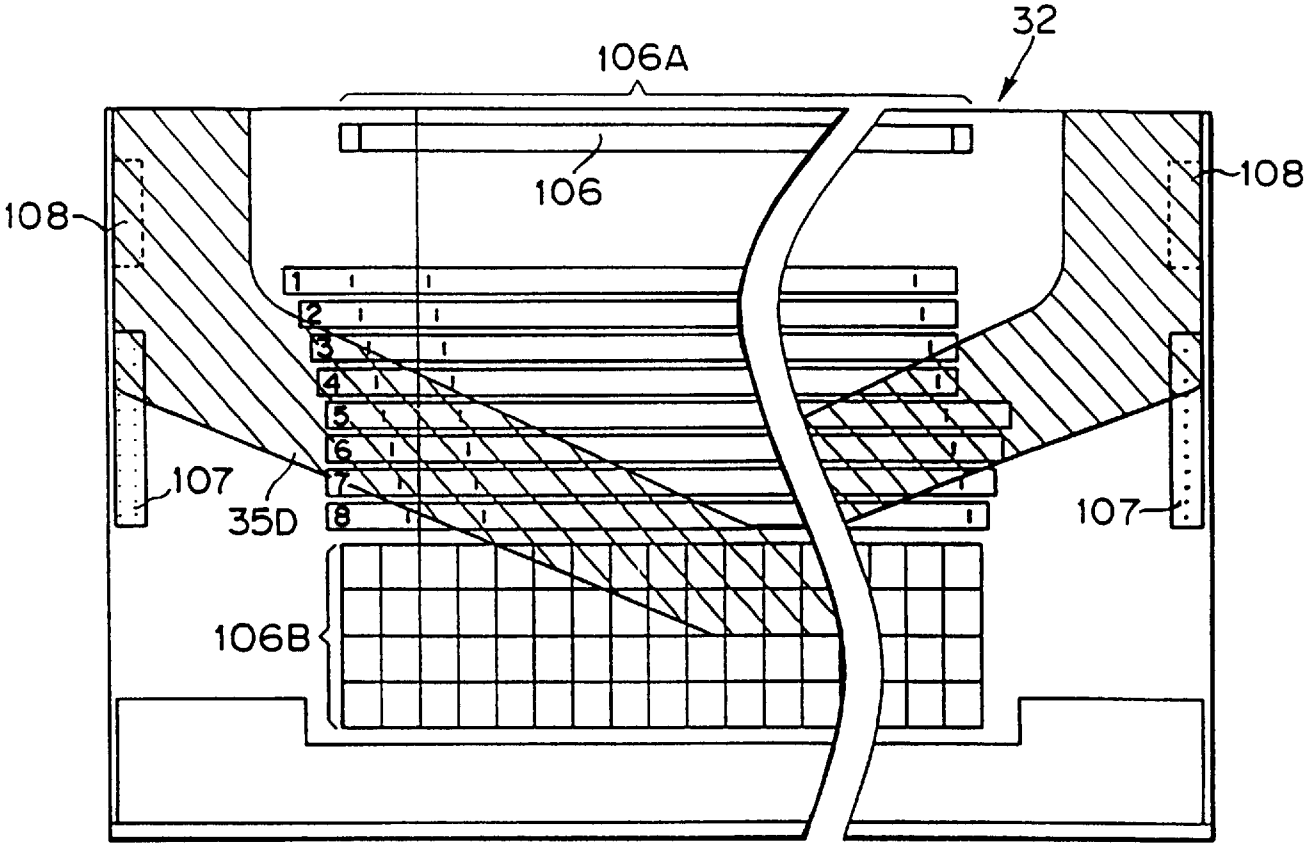
FIG. 4 PRIOR ART
FIG. 4 is a plan view showing a construction of a heater board in the printing head.

Next, one example of a construction of the printing head 105 applicable for the present invention will be discussed with reference to FIGS. 3 and 4. In FIGS. 3 and 4, 106 denotes the ejection heater which is heated by application of a drive pulse. Reference numeral 32 denotes a heater board, on which the ejection heater 106, a driver for forming the drive pulse to the ejection heater, a shift register, a latch, a diode sensor for detecting temperature of the printing head and so on are constructed on the same silicon substrate by a semiconductor fabrication technology. Reference numeral 33 denotes a base plate formed by punching of an aluminum plate. The heater board 32 is fixed on the base plate 33 by a bond 34. Reference numeral 35 denotes a ceiling plate, in which a groove 35A internally defining a plurality of liquid passages, ejection orifices 35B and a common liquid chamber 35C commonly communicated with the grooves 35A are integrally formed. In FIGS. 3 and 4, the size of the ejection heater 106 is 115×40 μm, a liquid passage length is 300 μm, and a distance from the tip end of the ejection heater 106 to the end surface of the heater board 32 is 105 μm, a thickness of the wall where the ejection orifices 35B are formed is 57 μm, and a cross-sectional area of the opening portion of the ejection orifices 35B is designed at 880 $\mu m^2$.

FIG. 4 diagrammatically shows the heater board 32 of the printing head 105 used in the shown embodiment. A temperature adjusting (sub) heater 107 for controlling temperature of the head, an ejecting portion array 106A where ejection (main) heaters 106 for ejecting ink are arranged, the drive elements 106B, and diode sensors 108 for detecting head temperature are formed in a positional relationship with each other shown in FIG. 4 on a common substrate. By arranging respective elements on the common substrate, detection of the head temperature and control can be performed efficiently. Also, by such arrangement, the head can be formed in compactly and the fabrication process can be simplified. Also, FIG. 4 shows a positional relationship of the section of the peripheral wall 35D of the ceiling plate 35 separating a region where the heater board is filled with ink from a region without ink. The ejection heater side of the peripheral wall 35D of the ceiling plate serves as the common liquid chamber 35C. It should be noted that the liquid passages are formed by the groove portions 35A formed in the peripheral wall of the ceiling plate positioned above the ejecting portion array 106A.

Upon formation of the image by ejecting recording liquid droplets from the printing head 105, the temperature of the printing head 105 is predicted by an arithmetic means provided in the CPU 101 on the basis of the output value of the temperature sensor 25 for detecting the temperature within the apparatus, and past driving hystereses of the sub-heater 107 and the ejection heater 106, or is detected on the basis of the output value of the temperature sensor 108 provided within the printing head 105 for detecting the temperature therein.

On the basis of the detected temperature, the drive condition of the sub-heater 107 and the ejection heater 106 elevating the temperature of the printing head 105 is controlled. As one of driving methods, a target value for a temperature control for the printing head 105 is determined and temperature control is performed in such a manner that when the temperature of the printing head 105 is lower than the target value of the temperature control and the difference between the temperature of the printing head and the target value of the temperature control is large, the temperature is elevated near the target value by means of the sub-heater 107, and remaining temperature difference is controlled by the control of the drive pulse for the ejection heater, namely by controlling the pulse widths of the pre-heating pulse and the main heating pulse and/or the interval between the pre-heating pulse and the main heating pulse. In this manner, the ejection amount can be unified. By this, variation of ejection amount in one line or one page can be prevented to make it possible to reduce fluctuation in density.

Figure 5:
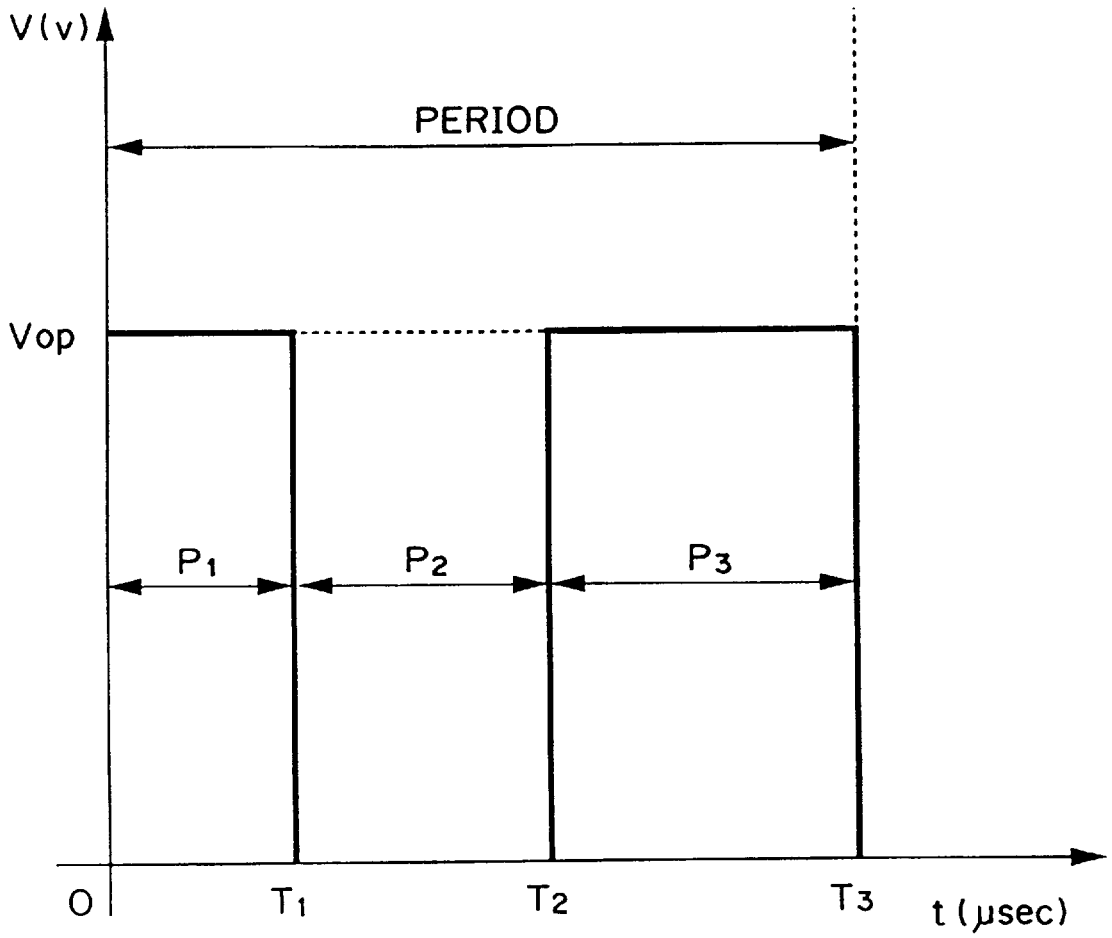
FIG. 5 PRIOR ART
FIG. 5 is a graph showing a drive pulse to be charged to a heater for ejection, for explaining of the embodiment of the invention.

FIG. 5 shows a drive pulse as the drive signal to be applied to the ejection heater 106 in the shown embodiment of the ink-jet printing apparatus according to the invention.

In FIG. 5, $V_{op}$ denotes a drive voltage, P1 denotes a pulse width of the pre-heating pulse, P2 denotes an interval time, P3 denotes a pulse width of the main heating pulse. T1, T2 and T3 denote timings of setting of P1, P2 and P3. The drive voltage $V_{op}$ is set at a value determined in consideration of a resistance value of the ejection heater 106, a film thickness of a protective layer formed on the ejection heater 106, a material, a composition of a solvent of the ink. In practice, in order to avoid formation of a core of a bubble immediately before formation of a bubble on the ejection heater, which otherwise would be a cause of fluctuation of the ejection liquid droplets, the drive voltage is typically set at a high value near a rated voltage value of the drive control system. Manner of modulation of the drive pulse width is to sequentially provide pulses with pulse widths of P1, P2 and P3. The pre-heating pulse is a pulse for controlling the temperature of the ink within the liquid passage 35A in the vicinity of the ejection heater 106. The pulse width is set at a value not to cause generation of a bubble in the ink by application of this pre-heating pulse.

The interval time is provided for providing a given time interval between the pre-heating pulse and the main heating pulse for avoiding mutual interference and for making the temperature distribution of the ink within the ink flow passages unify. The main heating pulse is a pulse for making the recording droplet to be ejected through the ejection orifice with forming the bubble on the ejection heater 106.

As one example, in the case of the printing head shown in FIG. 3, it is designed to have 83 ng of average ejection amount per ejection with taking driving voltage $V_{op}$=24 V, pre-heating pulse width P1=0.905 μs, the interval time P2=1.488 μs, the main heating pulse width P3=3.077 μs as a standard driving condition.

Figure 6:
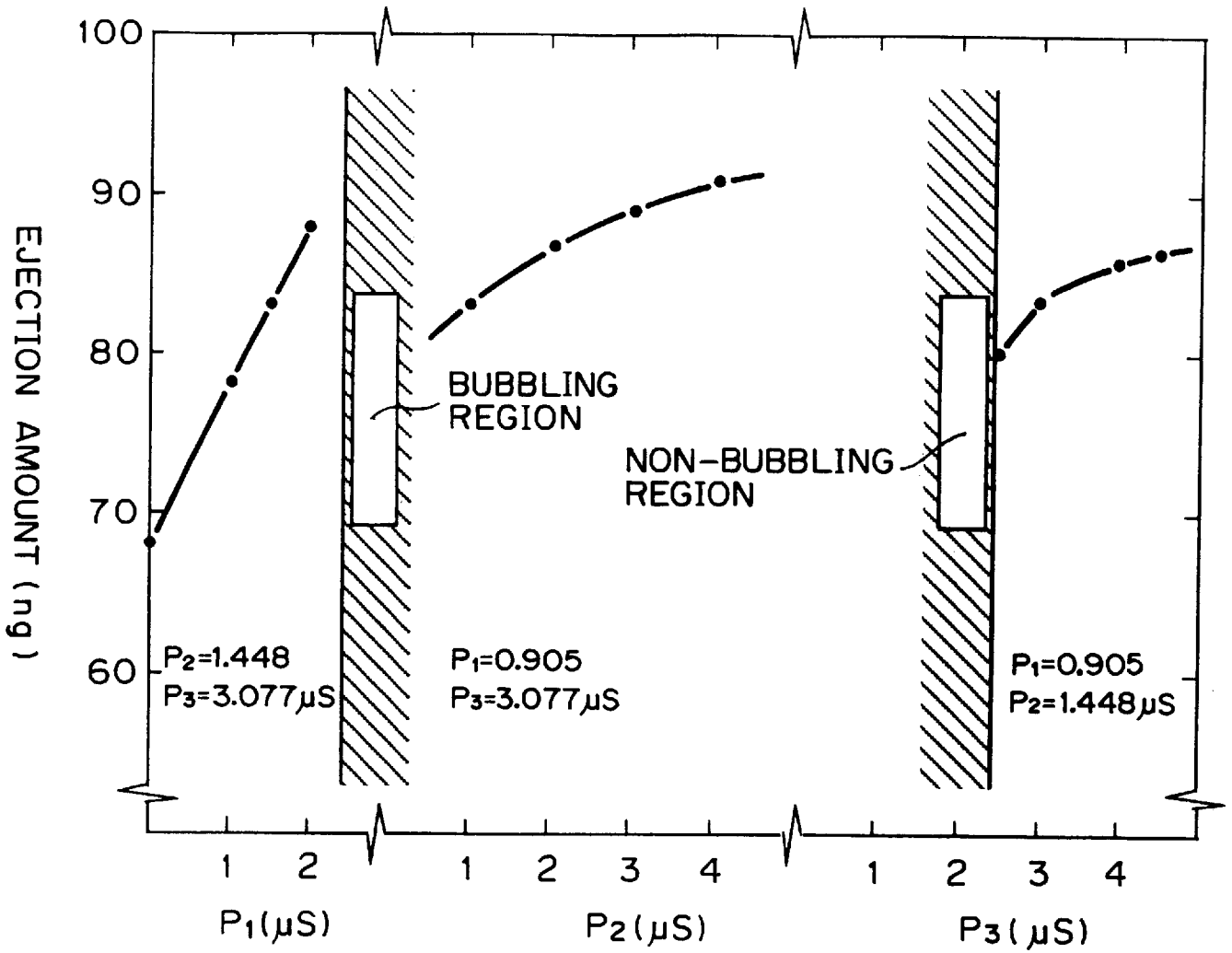
FIG. 6 is a graph showing correspondence between a drive condition and an ejection amount.

FIG. 6 shows correspondence between P1, P2 and P3 and the ejection amount when P1, P2 and P3 are varied with reference to the standard drive condition. As set forth, the pre-heating pulse is the pulse for controlling the ink temperature within the liquid passage 35A in the vicinity of the ejection heater 106. The ejection amount is increased according to increasing of the pulse width P1. However, in the range of P1≧2.4 μs, bubbling is caused by the pre-heating pulse. Therefore, the pulse width P1 is set in a range of P1<2.4 μs. The interval time P2 is provided for unifying temperature distribution of the ink within the liquid passage. According to increasing of P2, the ejection amount is also increased and reaches a saturation point in the vicinity of P2≈5 μs. Similarly, according to the pulse width P3 of the main heating pulse, the ejection amount is increased and reaches a saturation point in the vicinity of P3≈4 μs.

Figure 7:
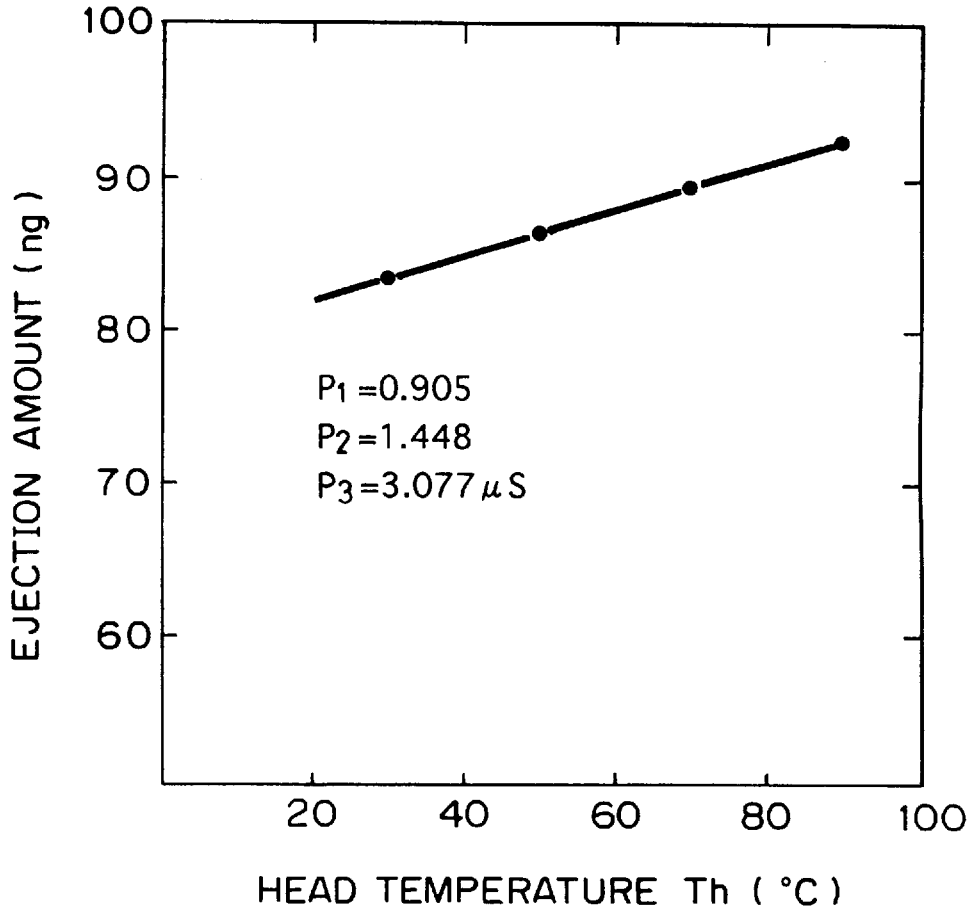
FIG. 7 is a graph showing correspondence between a head temperature and an ejection amount.

On the other hand, another factor for determining the ejection amount of the printing head is the temperature of the ink within the printing head 105. FIG. 7 shows a temperature dependency of the ejection amount by the printing head having the construction as discussed with respect to FIG. 3. The ejection amount is linearly increased corresponding to rising of the head temperature Th with a variation rate of 0.3 (ng/°C.).

Figure 8:
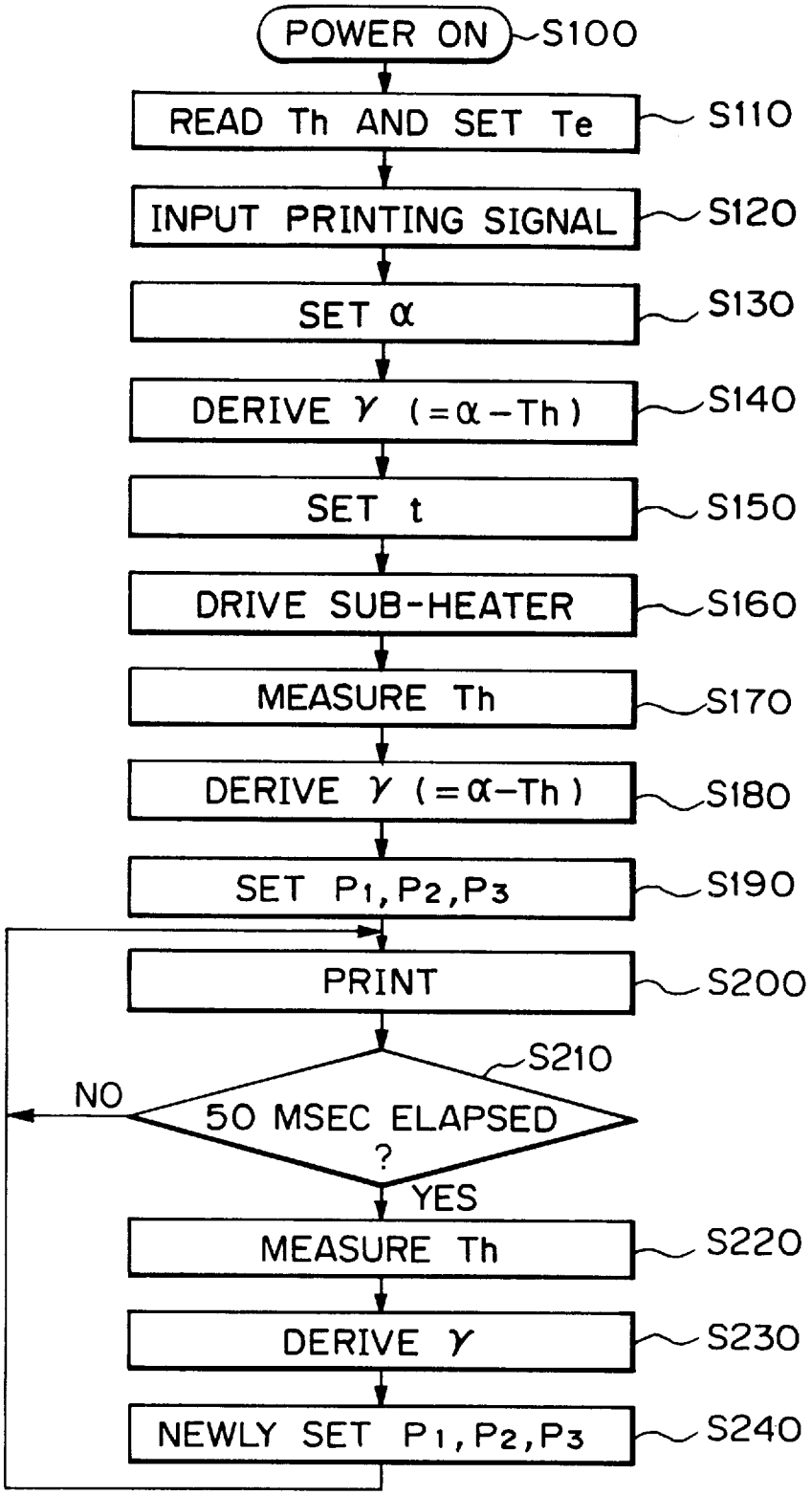
FIG. 8 is a flowchart showing one embodiment of a control process of the embodiment of the invention.

As set forth above, owing to drive pulse dependency or head temperature dependency of the ejection amount, control of ejection amount and restriction of the input energy to the printing head at high temperature, namely prevention of excessive elevation of the temperature of the printing head can be done. The operation in performing recording with employing the recording apparatus as set forth above will be discussed hereinafter with reference to the flowchart of FIG. 8.

When a power source is turned ON at step S100, the head temperature Th is read by means of a diode sensor 108 for detecting an ink temperature within the printing head 105 (step S110). The head temperature Th is input to the CPU 101 in the apparatus as the environmental temperature Te of the printing head under assumption that the initial temperature distribution within the apparatus upon ON-set of the power supply is uniform. At this time, when a period from turning OFF of the power source to turning ON, it is possible that the temperature of the printing head 105 is higher than the environmental temperature due to past printing hysteresis. In order to avoid this, it is desirable to separately provide the temperature sensor 25 for detecting the temperature within the apparatus. However, the following discussion will be given for the embodiment where the temperature sensor for detecting the temperature within the apparatus is not provided. When such temperature sensor 25 for detecting the temperature within the apparatus is present, the environmental temperature Te may be directly set on the basis of the output value of the temperature sensor 25.

Next, when a print signal is input at step S120, a target (drive) temperature table as shown in the following table 1 is made reference to, at step S130 to derive a printing target temperature α, at which optimal driving of the printing head under the current environmental temperature Te is carried out.

TABLE 1

| Environmental Temperature (°C.) | Target Temperature (°C.) |
|---|---|
| ~12 | 35 |
| 12~15 | 33 |
| 15~16 | 31 |
| 16~17 | 29 |
| 17~19 | 27 |
| 19~21 | 25 |
| 21~ | 23 |

In the foregoing table 1, the reason why the target temperature is differentiated depending upon the environmental temperature is because, even when the temperature on the silicon heater board of the printing head 105 is controlled to a given value, the ink temperature flowing thereinto is low and the ink has large thermal constant, the average temperature of the system around the head chip is inherently lowered. Therefore, it becomes necessary to make the target temperature of the silicon heater board of the head higher at lower environmental temperature Te.

Next, at step S140, a difference γ (=α−Th) between the printing target temperature α and the current actual head temperature (Th) is derived. Then, at step S150, with making reference to the following sub-heater control table (table 2), the target ON time (t) of the sub-heater 107 for reducing the difference γ is derived. Then, according to the time (t), power is supplied to the sub-heater (step S160). It should be noted that when the difference is positive (when the target temperature α is higher than the actual head temperature Th), power supply is performed. Corresponding to increasing of the difference, the power supply period is prolonged. This is because, when there is a difference between the actual temperature of the head and the target temperature before initiation of printing, the temperature of the overall printing head 105 is elevated by the sub-heater 107. By this, the temperature of the overall printing head 105 can become as close to the target temperature as possible.

TABLE 2

| Difference γ (°C.) | ON Period of Sub-Heater (sec) |
|---|---|
| ~+15 | 6 |
| +15~+12 | 5 |
| +12~+9 | 4 |
| +9~+6 | 3 |
| +6~+5 | 2 |
| +5~+4 | 1 |
| +4~+3 | 0.5 |
| +3~+2 | 0.2 |
| +2~ | 0 |

After turning ON the sub-heater 107 with the set period in the foregoing table, the sub-heater is turned OFF. Subsequently, at step S170, the head temperature Th is read by the diode sensor 108 in the printing head 105 for measuring the temperature Th in the printing head (ink temperature). Then, at step 180, the difference γ (=α−Th) between the printing target temperature α and the current head temperature (Th) is calculated again. Thereafter, the drive pulse condition upon initiation of printing is derived from a drive pulse correspondence table (table 3) depending upon the calculated difference γ (step S190). As a practical problem, it is difficult to precisely adjust the head temperature to be close enough to the target temperature even with employing the sub-heater 107. Furthermore, it is difficult to perform temperature compensation over one line during printing, by the sub-heater alone. Therefore, in the shown embodiment, correction of the ejection amount is made by modulating the drive pulse depending upon the target value and the remaining difference.

Particularly, according to the present invention, when the head temperature is low and the difference γ (=α−Th) between the printing target temperature α and the current head temperature (Th) is a positive value, such as upon initiation of printing immediately after turning ON of power supply, the pre-heating pulse and the main heating pulse are provided and a method of increasing ejection amount by increasing the value of the pulse width P1 of the pre-heating pulse or the interval P2 depending upon increasing of the difference, as shown in the following table 3, is employed (in this embodiment, the interval P2 is increased depending upon increasing of the difference). Also, when the head temperature is high and the difference γ (=α−Th) between the printing target temperature α and the current head temperature (Th) is negative, such as upon continuous printing of a high density image, the drive signal is provided with only main heating pulse, and in the state where only main heating pulse is provided, elevation of the temperature of the printing head is suppressed by reducing the pulse width of the main heating pulse at higher temperature (when the absolute value of the difference is greater).

TABLE 3

| Difference γ (°C.) | P1 (μs) | P2 (μs) | P3 (μs) |
|---|---|---|---|
| ~+15 | 0.905 | 3.258 | 3.077 |
| +15~+12 | ↑ | 2.896 | ↑ |
| +12~+9 | ↑ | 2.534 | ↑ |
| +9~+6 | ↑ | 2.172 | ↑ |
| +6~+5 | ↑ | 1.810 | ↑ |
| +5~+4 | ↑ | 1.448 | ↑ |

TABLE 3-continued

| Difference γ (°C.) | P1 (μs) | P2 (μs) | P3 (μs) |
|---|---|---|---|
| +4~+3 | ↑ | 1.086 | ↑ |
| +3~+2 | ↑ | 0.724 | ↑ |
| +2~+1 | ↑ | 0.363 | ↑ |
| +1~0 | ↑ | 0.181 | ↑ |
| 0~−2 | 0.0 | 0.0 | ↑ |
| −2~−6 | ↑ | ↑ | 2.896 |
| −6~−10 | ↑ | ↑ | 2.715 |
| −10~−16 | ↑ | ↑ | 2.534 |
| −16~−22 | ↑ | ↑ | 2.353 |
| −22~−30 | ↑ | ↑ | 2.172 |
| −30~ | ↑ | ↑ | 1.991 |

In the present embodiment, in printing over one line, the drive pulse is modulated for optimization at every given period of printing.

For example, one line is divided into areas of 50 msec each. The optimal drive pulse at each area is set in a manner set out below. Namely, after initiation of printing at step S200, upon expiration of the period of 50 msec, the head temperature is read by means of the diode sensor 108 in the printing head 105 (steps S210 and S220) and thus the temperature in the printing head (ink temperature) Th is determined. Then, at step S230, the difference γ (=α−Th) between the printing target temperature α and the current head temperature (Th) is calculated again. Thereafter, the drive pulse condition upon renewal of printing is derived from the drive pulse correspondence table (table 3) depending upon the calculated difference γ. Thereafter, printing is resumed (step 200), By performing control as set forth above, the head temperature gradually approaches the printing target temperature α. Therefore, in the case of large temperature difference between the head temperature (Th) and the printing target temperature α, such as upon the initial state after turning ON of the power supply, the ejection amount can be accurately controlled by performing modulation of the drive pulse waveform within one line.

Furthermore, as after the continuous printing of the high density image, if the head temperature is high and the difference γ (=α−Th) between the printing target temperature α and the current head temperature (Th) is a negative value, the drive signal contains only the main heating pulse and the pulse width of the main heating pulse is set smaller at higher temperature of the printing head so as to suppress elevation of the temperature of the printing head and thus to avoid degradation of the printed image quality due to excessively high temperature.

Figure 9:
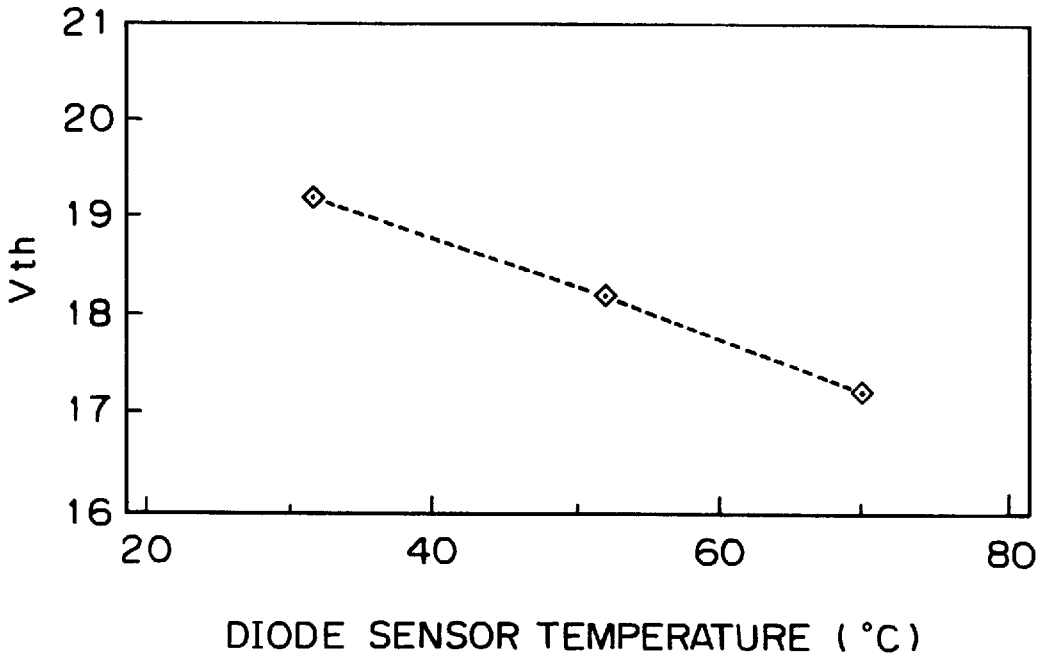
FIG. 9 is a graph showing correspondence between the head temperature and Vth (lower limit value of an ejection voltage).

Additional discussion will be given for technical background which permits lowering of the input energy by reducing the pulse width P3 of the main heating pulse at higher temperature of the printing head, with providing only main heating pulse in the drive pulse. FIG. 9 shows correspondence between the temperature measured by the diode sensor in the printing head, i.e. the ink temperature and an ejection lower limit voltage Vth when the pulse width of the drive pulse is held at a given constant value, under a relatively high temperature state in the printing head having the structure as discussed with respect to FIG. 3. The ejection lower limit voltage Vth is a critical value of bubbling by means of the ejection heater. By multiplying Vth by a given coefficient, an optimal drive voltage is set. Accordingly, it should be understood that when the printing head is high temperature, a stable recording liquid droplet depending upon the head temperature can be formed by gradually lowering the drive voltage (input energy of the drive pulse).

The ejection amount control and head temperature control in the shown embodiment set forth above will be summarized as follows.

Determining the target temperature of the head, at which ejection becomes the most stable, control is performed so that the temperature of the printing head reaches the target temperature.

The target temperature is derived from "target temperature table". The target temperature depends on the environmental temperature in the surrounding.

When the head temperature is lower than the target temperature and the difference therebetween is large, the head temperature control is performed by heating of the sub-heater.

When the head temperature is lower than the target temperature and the difference therebetween is small, the head temperature control is performed by self-elevating of the temperature by the drive pulse.

When the head temperature is higher than the target temperature, temperature control is performed only by main heating pulse in such a manner that the drive pulse width is narrowed depending upon the absolute value of the difference for preventing self-elevation of the temperature.

Another Embodiment

In addition to the foregoing embodiment set forth above, discussion will be given for another embodiment of the present invention.

When the environmental temperature of the apparatus is high and when printing of high density image is continuously performed, elevation of temperature of the printing head becomes significant. As in the former embodiment, difficulty may be arisen to sufficiently prevent self-elevation of the temperature only by pulse width modulation of the drive pulse. In such case, it is preferred to perform the following control.

When the head temperature is low and the difference γ (=α−Th) between the printing target temperature α and the current head temperature (Th) is a positive value, as in the former embodiment of the invention set forth above, after determining the "target temperature" and driving the sub-heater 107, (when the deference γ is smaller than or equal to +2, the sub-heater is not driven), the head temperature is measured again to set optimal P2 (interval) depending upon the difference γ utilizing the following table 4. Thus, the ejection heater 106 is driven by double heating pulses of the pre-heating pulse and the main heating pulse.

When the head temperature is high and the difference γ (=α−Th) between the printing target temperature α and the current head temperature (Th) is a negative value, the drive pulse has only a main heating pulse, as shown in the following table 4. By making the pulse width of the main heating pulse depending upon the difference γ to be narrower at higher temperature of the head, elevation of the temperature of the printing head is suppressed. Also, at higher temperature (the region where the difference γ of the table 4 is lower than or equal to −16° C.), the input energy for the printing head 105 per unit period is lowered by lowering the printing frequency of the printing head to suppress elevation of the temperature of the printing head. In the table 4, the drive frequency in the normal temperature range is 10.0 kHz, and at the higher temperature (the difference γ is lower than or equal to −16° C., namely, when the head temperature is higher than the target temperature in the magnitude of the temperature difference +16° C.), the drive frequency is lowered at 6.25 kHz.

By this, when the head temperature is higher than the target temperature, by controlling both of the drive pulse width and the drive frequency, self-elevation of the temperature can be efficiently prevented.

TABLE 4

| Difference γ (°C.) | P1 (μs) | P2 (μs) | P3 (μs) | Drive Frequency |
|---|---|---|---|---|
| ~+15 | 0.905 | 3.258 | 3.077 | 10.0 kHz |
| +15~+12 | ↑ | 2.896 | ↑ | ↑ |
| +12~+9 | ↑ | 2.534 | ↑ | ↑ |
| +9~+6 | ↑ | 2.172 | ↑ | ↑ |
| +6~+5 | ↑ | 1.810 | ↑ | ↑ |
| +5~+4 | ↑ | 1.448 | ↑ | ↑ |
| +4~+3 | ↑ | 1.088 | ↑ | ↑ |
| +3~+2 | ↑ | 0.724 | ↑ | ↑ |
| +2~+1 | ↑ | 0.363 | ↑ | ↑ |
| +1~0 | ↑ | 0.181 | ↑ | ↑ |
| 9~−2 | 0.0 | 0.0 | ↑ | ↑ |
| −2~−6 | ↑ | ↑ | 2.896 | ↑ |
| −6~−10 | ↑ | ↑ | 2.715 | ↑ |
| −10~−16 | ↑ | ↑ | 2.534 | ↑ |
| −16~−22 | ↑ | ↑ | 2.353 | 6.25 kHz |
| −22~−30 | ↑ | ↑ | 2.172 | ↑ |
| −30~ | ↑ | ↑ | 1.991 | ↑ |

Further embodiment of the present invention will be discussed.

Similarly to the immediately preceding embodiment, when the environmental temperature of the apparatus is high and printing of the high-density image is performed continuously, it is also preferred to perform control set forth below.

When the head temperature is low and the difference γ (=α−Th) between the printing target temperature α and the current head temperature (Th) is a positive value, as in the former embodiment of the invention set forth above, after determining the "target temperature" and driving the sub-heater 107, (when the difference γ is smaller than or equal to +2, the sub-heater is not driven), the head temperature is measured again to set optimal P2 (interval) depending upon the difference γ utilizing the following table 5. Thus, the ejection heater 106 is driven by double heating pulses of the pre-heating pulse and the main heating pulse.

When the head temperature is high and the difference γ (=α−Th) between the printing target temperature α and the current head temperature (Th) is a negative value, the drive pulse has only a main heating pulse, as shown in the following table 5. By making the pulse width of the main heating pulse depending upon the difference γ to be narrower at higher temperature of the head, elevation of the temperature of the printing head is suppressed. Also, at higher temperature (the region where the difference γ of the table 5 is lower than or equal to −16° C.), the input energy for the printing head 105 per unit period is further lowered by prolonging a period for maintaining the printing head 105 at resting at opposite ends in the scanning directions. In the table 5, the resting period at opposite ends in the scanning directions in the normal temperature range is 50 msec, and at the higher temperature (the difference γ is lower than or equal to −16° C., namely, when the head temperature is higher than the target temperature in the magnitude of the temperature difference +16° C.), the resting period is prolonged to 200 msec. By this, when the head temperature is higher than the target temperature, by controlling both the drive pulse width and the resting period at opposite ends in the scanning directions, self-elevation of temperature can be efficiently prevented.

TABLE 5

| Difference γ (°C.) | P1 (μs) | P2 (μs) | P3 (μs) | Resting Period at Opposite Ends in Scanning Directions |
|---|---|---|---|---|
| ~+15 | 0.905 | 3.258 | 3.077 | 50 msec |
| +15~+12 | ↑ | 2.896 | ↑ | ↑ |
| +12~+9 | ↑ | 2.534 | ↑ | ↑ |
| +9~+6 | ↑ | 2.172 | ↑ | ↑ |
| +6~+5 | ↑ | 1.810 | ↑ | ↑ |
| +5~+4 | ↑ | 1.448 | ↑ | ↑ |
| +4~+3 | ↑ | 1.088 | ↑ | ↑ |
| +3~+2 | ↑ | 0.724 | ↑ | ↑ |
| +2~+1 | ↑ | 0.363 | ↑ | ↑ |
| +1~0 | ↑ | 0.181 | ↑ | ↑ |
| 0~−2 | 0.0 | 0.0 | ↑ | ↑ |
| −2~−6 | ↑ | ↑ | 2.896 | ↑ |
| −6~−10 | ↑ | ↑ | 2.715 | ↑ |
| −10~−16 | ↑ | ↑ | 2.534 | ↑ |
| −16~−22 | ↑ | ↑ | 2.353 | 200 msec |
| −22~−30 | ↑ | ↑ | 2.172 | ↑ |
| −30~ | ↑ | ↑ | 1.991 | ↑ |

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing method for performing printing on a recording medium by ejecting ink from an ink-jet printing head provided in an ink-jet printing apparatus, said printing head having ejection orifices utilizing thermal energy, comprising the steps of:

setting a target temperature, at which ejection of said ink-jet printing head is most stable, on the basis of an environmental temperature;

determining an actual temperature of said ink-jet printing head;

deriving a difference between the set target temperature and the actual temperature of said ink-jet printing head by subtracting the actual temperature from the target temperature, the difference including a magnitude and a sign;

determining energy supplied for said ink-jet printing head by deriving an optimum value of a drive signal which supplies at least said thermal energy so that the temperature of said ink-jet printing head may reach said target temperature corresponding to the magnitude of the difference, wherein (i) when the difference derived in said deriving step is positive, said drive signal includes a pre-heating pulse providing thermal energy which does not cause bubbling of said ink, a main heating pulse providing thermal energy which causes bubbling of said ink for ejection of ink from the ejection orifices and an interval between said pre-heating pulse and said main heating pulse, said pre-heating pulse and said main heating pulse each having a pulse width, the pulse width of each of said pre-heating pulse and said main heating pulse being greater than zero and a value of the given interval also being greater than zero, and values of the pulse widths and the given interval being optimized depending upon the difference, and (ii) when the difference derived in said deriving step is negative, said drive signal includes only a main heating pulse, the width of said main heating pulse being reduced according to increasing of the magnitude of the difference; and supplying said drive signal to said ink-jet printing head.

2. An ink-jet printing method as claimed in claim 1, further comprising the step of setting a predetermined value, wherein said ink-jet printing head is provided with a heater for heating, and when said difference derived in said deriving step is positive and exceeds the predetermined value, said ink-jet printing head is heated for a given period by said heater for heating.

3. An ink-jet printing method as claimed in claim 1, wherein said pre-heating pulse and said main heating pulse are predetermined values with a constant width, respectively, and said interval is increased corresponding to increasing of said difference, when said difference derived in said deriving step is positive.

4. An ink-jet printing method as claimed in claim 1, wherein said main heating pulse has a drive frequency, said method further comprising the steps of:

setting a predetermined value; and lowering the drive frequency of said main heating pulse when said difference derived in said deriving step is negative and the magnitude of said difference is greater than the predetermined value.

5. An ink-jet printing method as claimed in claim 1, further comprising the steps of setting a predetermined value and scanning said ink-jet printing head and placing said ink-jet printing head at a resting state for a predetermined resting period at opposite ends in scanning directions, wherein said predetermined resting period is prolonged, when said difference is negative and the magnitude thereof is greater than the predetermined value.

6. An ink-jet printing method as claimed in claim 1, wherein said environmental temperature is set by measuring a temperature in the apparatus by a temperature sensor arranged within said ink-jet printing apparatus and setting on the basis of said measured temperature.

7. An ink-jet printing method as claimed in claim 1, wherein said environmental temperature is set on the basis of a temperature detected by a head temperature detecting means upon expiration of a predetermined period after turning off of a power source of said ink-jet printing apparatus.

8. An ink-jet printing apparatus for performing printing on a recording medium by employing an ink-jet printing head which ejects ink through ejection orifices utilizing thermal energy, comprising:

target temperature setting means for setting a target temperature, at which ejection through said ink-jet printing head is most stable, on the basis of an environmental temperature;

head temperature detecting means for detecting an actual temperature of said ink-jet printing head;

temperature difference deriving means for deriving a difference between the target temperature set by said target temperature setting means and the actual temperature detected by said head temperature detecting means;

drive signal setting means for setting a drive signal at an optimum value for providing said thermal energy so that a temperature of said ink-jet printing head may reach said target temperature depending upon the difference derived by said deriving means; and drive control means for controlling driving of said ink-jet printing head based on the drive signal set by said drive signal setting means;

wherein (i) when the difference derived by said deriving means is positive, said drive signal includes a pre-heating pulse providing thermal energy which does not cause bubbling of said ink, a main heating pulse providing thermal energy which causes bubbling of said ink for ejection of ink from the ejection orifices and an interval between said pre-heating pulse and said main heating pulse, said pre-heating pulse and said main heating pulse each having a pulse width, the pulse width of each of said pre-heating pulse and said main heating pulse being greater than zero and a value of the given interval also being greater than zero, and values of the pulse widths and the given interval being optimized depending upon the difference, and (ii) when the difference derived by said deriving means is negative, said drive signal includes only a main heating pulse, the width of said main heating pulse being reduced according to increasing of the magnitude of the difference.

9. An ink-jet printing apparatus as claimed in claim 8, wherein said ink-jet printing head is further provided with a heater for heating, and said apparatus further comprises means for setting a predetermined value and power supply control means for supplying power for a predetermined period for said heater when said difference derived by said deriving means exceeds the predetermined value.

10. An ink-jet printing apparatus as claimed in claim 8, wherein said pre-heating pulse and said main heating pulse are predetermined values with a constant width, respectively, and said interval is increased corresponding to increasing of said difference, when said difference derived by said deriving means is positive.

11. An ink-jet printing apparatus as claimed in claim 8, wherein said main heating pulse has a drive frequency and said apparatus further includes means for setting a predetermined value and means for lowering the drive frequency of said main heating pulse when said difference derived by said deriving means is negative and the magnitude of said difference is greater than the predetermined value.

12. An ink-jet printing apparatus as claimed in claim 8, further comprising means for setting a predetermined value and shifting control means for reciprocally scanning said ink-jet printing head in scanning directions and for placing said ink-jet printing head at a resting state for a predetermined resting period at opposite ends in the scanning directions, wherein said shifting control means prolongs said predetermined resting period when said difference is negative and the magnitude thereof is greater than the predetermined value.

13. An ink-jet printing apparatus as claimed in claim 8, further comprising a temperature sensor arranged within said apparatus;

wherein said temperature sensor detects said environmental temperature.

14. An ink-jet printing apparatus as claimed in claim 8, wherein said environmental temperature is derived from a temperature detected by said heat temperature detecting means upon expiration of a predetermined period after turning off of a power source of said ink-jet printing apparatus.

* * * * *

UNITED STATES PATENT AND TRADEMARK OFFICE

CERTIFICATE OF CORRECTION

PATENT NO. : 5,838,340 Page 1 of 2

DATED : November 17, 1998

INVENTOR(S) : SHIMODA

It is certified that error appears in the above-identified patent and that said Letters Patent is hereby corrected as shown below:

On the title page, item

[56] References Cited:

FOREIGN PRIORITY DOCUMENTS,

"3277553" should read --3-277553--,

"4250057" should read --4-250057--, and

"5064890" should read --5-064890--.

COLUMN 6:

Line 16, "in" should be deleted.

COLUMN 7:

Line 20, "in" should be deleted.

UNITED STATES PATENT AND TRADEMARK OFFICE

CERTIFICATE OF CORRECTION

PATENT NO. : 5,838,340 Page 2 of 2

DATED : November 17, 1998

INVENTOR(S) : SHIMODA

It is certified that error appears in the above-identified patent and that said Letters Patent is hereby corrected as shown below:

COLUMN 13:

Line 23, "9~-2" should read --0~-2--.

Signed and Sealed this

Seventeenth Day of August, 1999

*Attest:*

Q. TODD DICKINSON

*Attesting Officer*

*Acting Commissioner of Patents and Trademarks*